US009347445B2

(12) United States Patent
Kwun et al.

(10) Patent No.: US 9,347,445 B2
(45) **Date of Patent: *May 24, 2016**

(54) LUBRICATION APPARATUS OF HIGH PRESSURE PUMP FOR COMMON RAIL SYSTEM

(71) Applicant: Hyundai Motor Company, Seoul (KR)

(72) Inventors: Sun Dong Kwun, Suwon-si (KR); Sung Il You, Gwacheon-si (KR); Chang Sun Hwang, Incheon (KR)

(73) Assignee: Hyundai Motor Company, Seoul (KR)

( * ) Notice: Subject to any disclaimer, the term of this patent is extended or adjusted under 35 U.S.C. 154(b) by 203 days.

This patent is subject to a terminal disclaimer.

(21) Appl. No.: 14/060,349

(22) Filed: Oct. 22, 2013

(65) Prior Publication Data

US 2015/0004012 A1 Jan. 1, 2015

(30) Foreign Application Priority Data

Jun. 26, 2013 (KR) ..... 10-2013-0073403

(51) Int. Cl.
*F04B 53/18* (2006.01)
*F04B 49/22* (2006.01)
*F04B 1/04* (2006.01)

(52) U.S. Cl.
CPC ..... *F04B 53/18* (2013.01); *F04B 1/0408* (2013.01); *F04B 1/0413* (2013.01)

(58) Field of Classification Search
CPC ..... F04B 53/18; F04B 49/22
USPC ..... 184/6.6; 123/196 R; 417/228, 364
See application file for complete search history.

(56) References Cited

U.S. PATENT DOCUMENTS

| | | | | |
|---|---|---|---|---|
| 4,565,172 | A * | 1/1986 | Hoshi | 123/446 |
| 4,915,592 | A * | 4/1990 | Hishinuma et al. | 417/206 |
| 6,016,790 | A * | 1/2000 | Makino et al. | 123/496 |
| 7,568,461 | B1 * | 8/2009 | Straub | 123/90.48 |
| 7,748,359 | B2 * | 7/2010 | Bartley et al. | 123/90.48 |
| 7,878,169 | B2 * | 2/2011 | Brinks | 123/90.48 |
| 8,967,037 | B2 * | 3/2015 | Jones et al. | 92/129 |
| 2008/0006233 | A1 * | 1/2008 | Bartley et al. | 123/90.48 |
| 2011/0052427 | A1 * | 3/2011 | Shaull et al. | 417/364 |

FOREIGN PATENT DOCUMENTS

| | | | |
|---|---|---|---|
| JP | 2001-221131 | A | 8/2001 |
| JP | 2001-317430 | A | 11/2001 |
| JP | 2008-286124 | A | 11/2008 |
| JP | 2010-249101 | A | 11/2010 |
| KR | 10-2005-0051372 | A | 6/2005 |
| KR | 10-2010-0058959 | A | 6/2010 |

* cited by examiner

*Primary Examiner* — William E Dondero
*Assistant Examiner* — Mark K Buse
(74) *Attorney, Agent, or Firm* — Morgan, Lewis & Bockius LLP

(57) ABSTRACT

A lubrication apparatus of a high pressure pump for a common rail system is configured such that a sufficient amount of lubrication fuel can be supplied from a low pressure pump to the frictional junction between a roller and a shoe within a short period of time, thereby efficiently improving the lubrication performance of the frictional junction.

9 Claims, 6 Drawing Sheets

LUBRICATION APPARATUS OF HIGH PRESSURE PUMP FOR COMMON RAIL SYSTEM

CROSS REFERENCE TO RELATED APPLICATION

The present application claims priority of Korean Patent Application Number 10-2013-0073403 filed Jun. 26, 2013, the entire contents of which application is incorporated herein for all purposes by this reference.

BACKGROUND OF INVENTION

1. Field of Invention

The present invention relates to a lubrication apparatus of a high pressure pump for a common rail system and, more particularly, to a lubrication apparatus of a high pressure pump for a common rail system which is configured such that it can realize improved lubrication performance of a frictional junction in which a roller and a shoe come into contact with each other.

2. Description of Related Art

Generally, as shown in FIGS. 1 and 2, a high pressure pump 10 used in a common rail system includes a pump housing 11, a roller 12, a shoe 13, and a plunger 14. Here, in the pump housing 11, a shaft chamber 11*a*, a roller chamber 11*b* and a spring chamber 11*c* are formed in such a way that the chambers communicate with each other.

In the shaft chamber 11*a*, a cam shaft 21 having a cam 21*a* is rotatably installed. In the roller chamber 11*b*, both the roller 12 and the shoe 13 are installed such that they come into contact with the cam 21*a*. In the spring chamber 11*c*, a spring 16 is installed using a spring seat 15.

Here, in the high pressure pump 10, the plunger 14 is installed in such a way that a first end thereof comes into contact with the shoe 13 and a second end thereof is located in a fuel compression chamber 17 that is formed between an inlet valve 22 and an outlet valve 23.

The inlet valve 22 is a valve that is installed in a fuel channel connected to a low pressure pump 24, and the outlet valve 23 is a valve that is installed in a fuel channel connected to a common rail 25.

Accordingly, when an engine is operated and the cam shaft 21 is rotated by the output power of the engine, the roller 12 is rotated according to a lift profile of the cam 21*a*, and pushes the shoe 13. Due to the pushed motion of the shoe 13, the plunger 14 reciprocates rectilinearly. Here, due to the rectilinear reciprocation of the plunger 14, low pressure fuel that has been supplied into the fuel compression chamber 17 through the inlet valve 22 is compressed to become high pressure fuel, and the high pressure fuel is discharged to the common rail 25 through the outlet valve 23.

Meanwhile, in the high pressure pump 10, the roller 12 and the shoe 13 are installed in such a way that they come into contact with each other under high pressure. Accordingly, when a frictional junction M1 in which the roller 12 and the shoe 13 come into contact with each other is not sufficiently lubricated, the contact surfaces of both the roller 12 and the shoe 13 are worn by friction and, occasionally, scuffing may be generated in the contact surfaces by severe friction. In an effort to solve the problems caused by friction, a technique in which the frictional junction M1 between the roller 12 and the shoe 13 is lubricated using fuel of the low pressure pump 24 is used in the related art.

In other words, in the related art, the fictional junction M1 between the roller 12 and the shoe 13 is lubricated by the fuel of the low pressure pump 24 using both a first lubrication channel 31 that connects the low pressure pump 24 to the shaft chamber 11*a* of the pump housing 11 and a second lubrication channel 32 that connects the shaft chamber 11*a* to the spring chamber 11*c*. That is, when the fuel of the low pressure pump 24 has filled the shaft chamber 11*a*, the fuel fills the spring chamber 11*c* and is fed to the frictional junction M1 between the roller 12 and the shoe 13, thereby lubricating the frictional junction M1.

However, the above-mentioned related art technique for lubricating the frictional junction M1 is problematic in that the passage through which the lubrication fuel flows to the frictional junction M1 between the roller 12 and the shoe 13 is too long, and so the cam shaft 21 may be operated before the frictional junction M1 between the roller 12 and the shoe 13 has been sufficiently lubricated, and, in the above state, the frictional junction M1 between the roller 12 and the shoe 13 on which a high compression load acts may be worn severely by the friction. Furthermore, scuffing is generated in the frictional junction M1 between the roller 12 and the shoe 13, thereby causing inferiority in the quality of the high pressure pump 10.

The information disclosed in this Background section is only for enhancement of understanding of the general background of the invention and should not be taken as an acknowledgement or any form of suggestion that this information forms the prior art already known to a person skilled in the art.

BRIEF SUMMARY

Accordingly, the present invention has been made keeping in mind the above problems occurring in the related art, and the present invention is intended to propose a lubrication apparatus of a high pressure pump for a common rail system, which can reduce the length of a passage through which lubrication fuel flows to the frictional junction between a roller and a shoe, thereby sufficiently lubricating the frictional junction between the roller and the shoe within a short period of time, and realizing improved lubrication performance of the frictional junction, and preventing frictional wear of both the roller and the shoe, and promoting an improvement in the operational performance of the high pressure pump.

Various aspects of the present invention provide for a lubrication apparatus of a high pressure pump for a common rail system, including: a first lubrication channel connecting a low pressure pump to a shaft chamber that is formed in a pump housing of the high pressure pump; a third lubrication channel formed through the pump housing so as to be connected to the first lubrication channel and to be open to a location in which a shoe is installed; and a support lubrication groove formed in the shoe such that the support lubrication groove is open to an outer surface of the shoe, in which a first end of the support lubrication groove is connected to the third lubrication channel and a second end of the support lubrication groove is connected to a frictional junction in which a roller and the shoe come into contact with each other.

The lubrication apparatus may further include: a check valve installed in the third lubrication channel and functioning to allow a flow of fuel from the first lubrication channel to the third lubrication channel and to prevent a reverse flow of the fuel from the third lubrication channel to the first lubrication channel.

The support lubrication groove may include: a first support groove connected to the third lubrication channel and extending in a lengthwise direction of the shoe; and a second support groove connected to the first support groove and being open to the frictional junction.

The second support groove may comprise a plurality of second support grooves that can supply a sufficient amount of fuel to the frictional junction within a predetermined short period of time.

In another aspect, the present invention provides a lubrication apparatus of a high pressure pump for the common rail system, including: a support lubrication groove formed in a shoe such that the support lubrication groove forms a passage for allowing fuel of a low pressure pump to flow so as to lubricate a frictional junction in which a roller and the shoe come into contact with each other.

Here, the support lubrication groove may be formed such that the support lubrication groove communicates with a channel through which the fuel of the low pressure pump is supplied to a shaft chamber in which a cam shaft is installed.

Further, the lubrication apparatus may further include: a check valve formed in an inlet of the support lubrication groove, the check valve functioning to allow a flow of the fuel from the low pressure pump to the frictional junction and to prevent a flow of the fuel from the frictional junction to the low pressure pump.

The support lubrication groove may be formed such that the support lubrication groove is open to an outer surface of the shoe.

The support lubrication groove may comprise: a first support groove formed such that a first end of the first support groove is connected to a channel through which the fuel of the low pressure pump is supplied to a shaft chamber in which a cam shaft is installed, and a second end of the first support groove extends in a lengthwise direction of the shoe; and a second support groove connected to the first support groove and being open to the frictional junction.

The second support groove may comprise a plurality of second support grooves that can supply a sufficient amount of fuel to the frictional junction within a predetermined short period of time.

As described above, the lubrication apparatus of the present invention is advantageous in that it can supply a sufficient amount of lubrication fuel from the low pressure pump to the frictional junction between the roller and the shoe within a short period of time, thereby minimizing frictional wear of the frictional junction and efficiently improving the durability of the high pressure pump.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
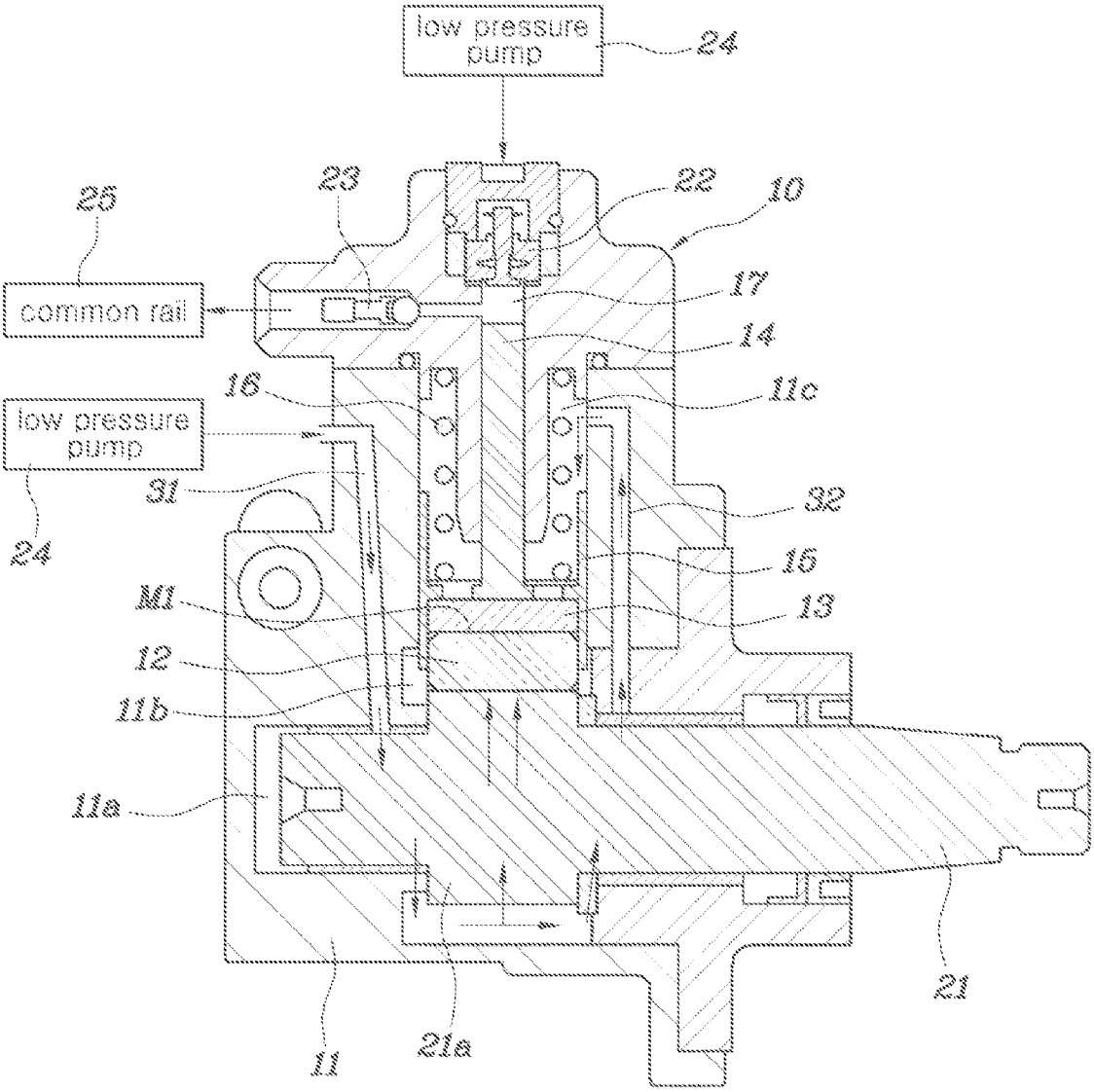
FIG. 1 (Related Art)
FIGS. 1 and 2 are views illustrating a conventional lubrication apparatus of a high pressure pump for the common rail system.
Figure 2:
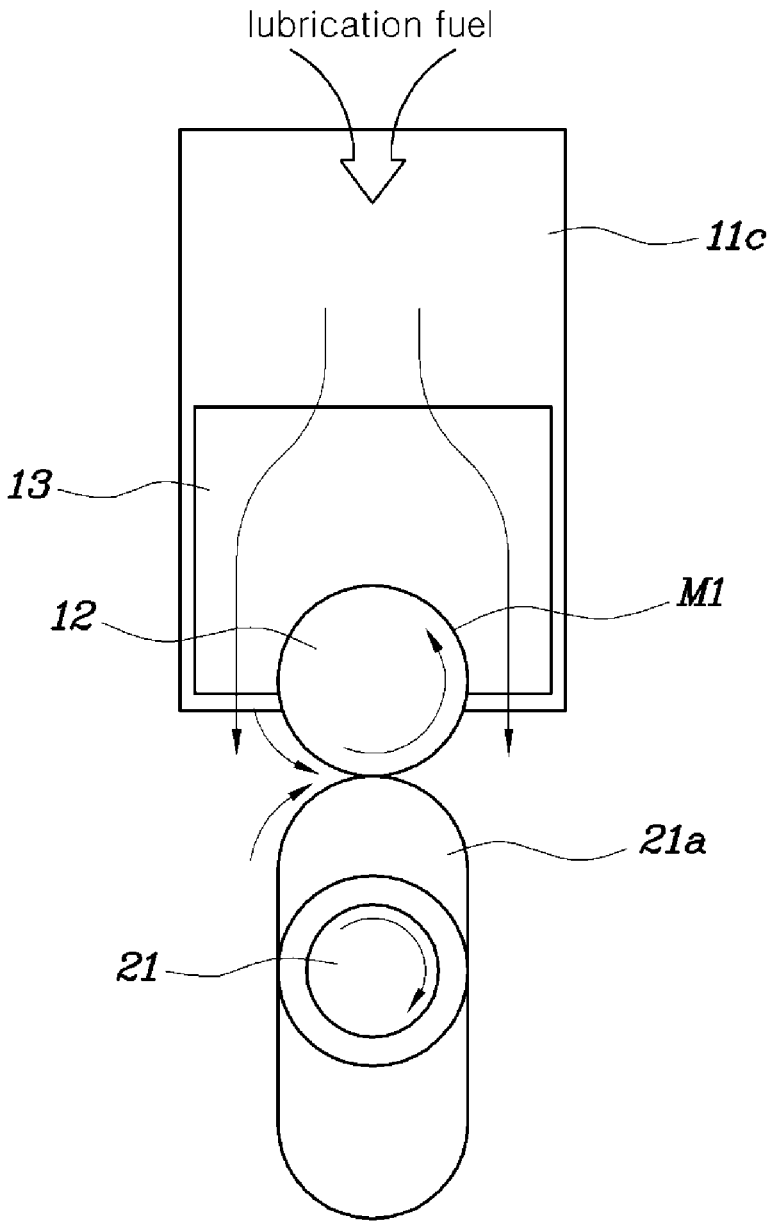
FIG. 2 (Related Art)
Figure 3:
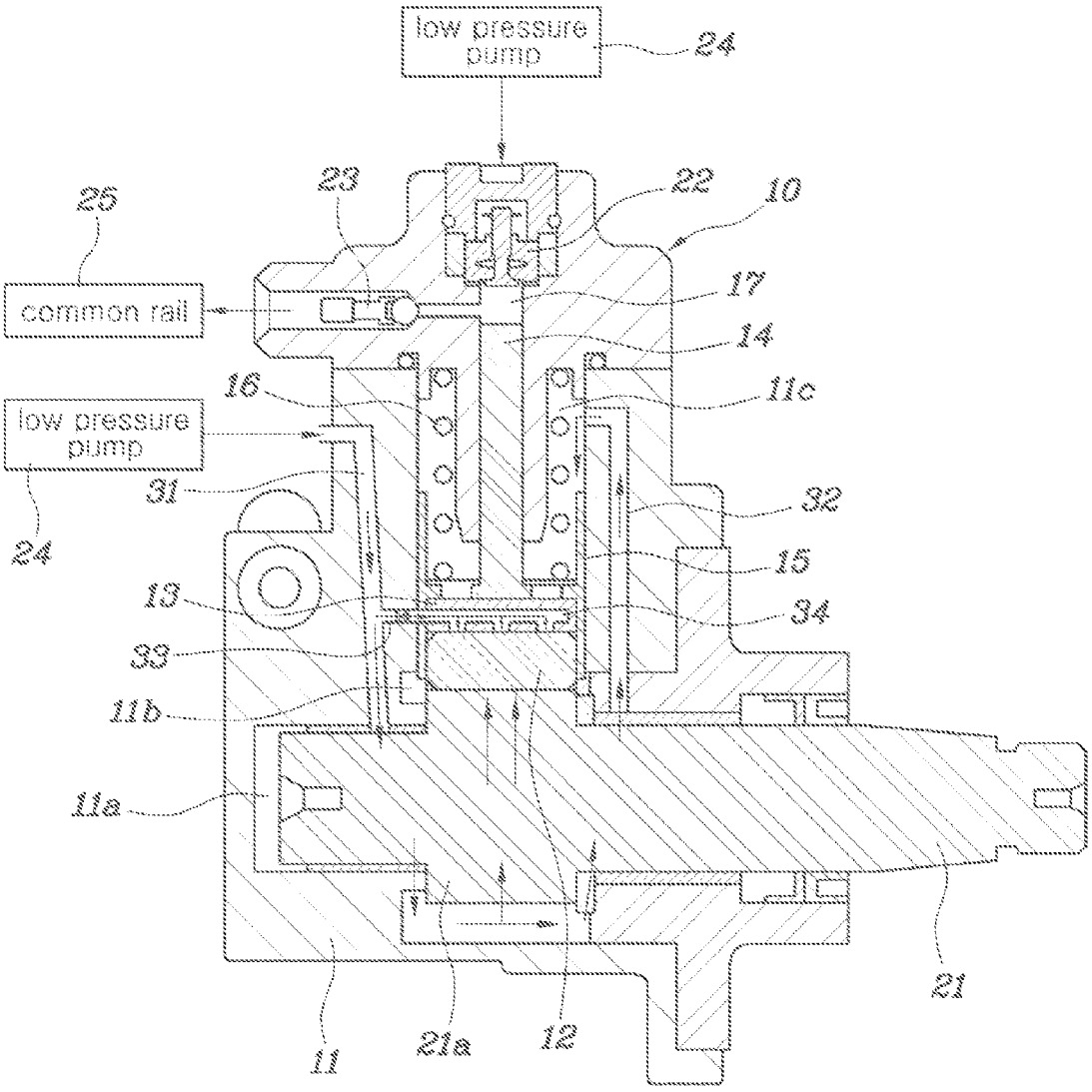
FIGS. 3, 4, 5 and 6 are views illustrating a lubrication apparatus of a high pressure pump for the common rail system according to the present invention.
Figure 4:
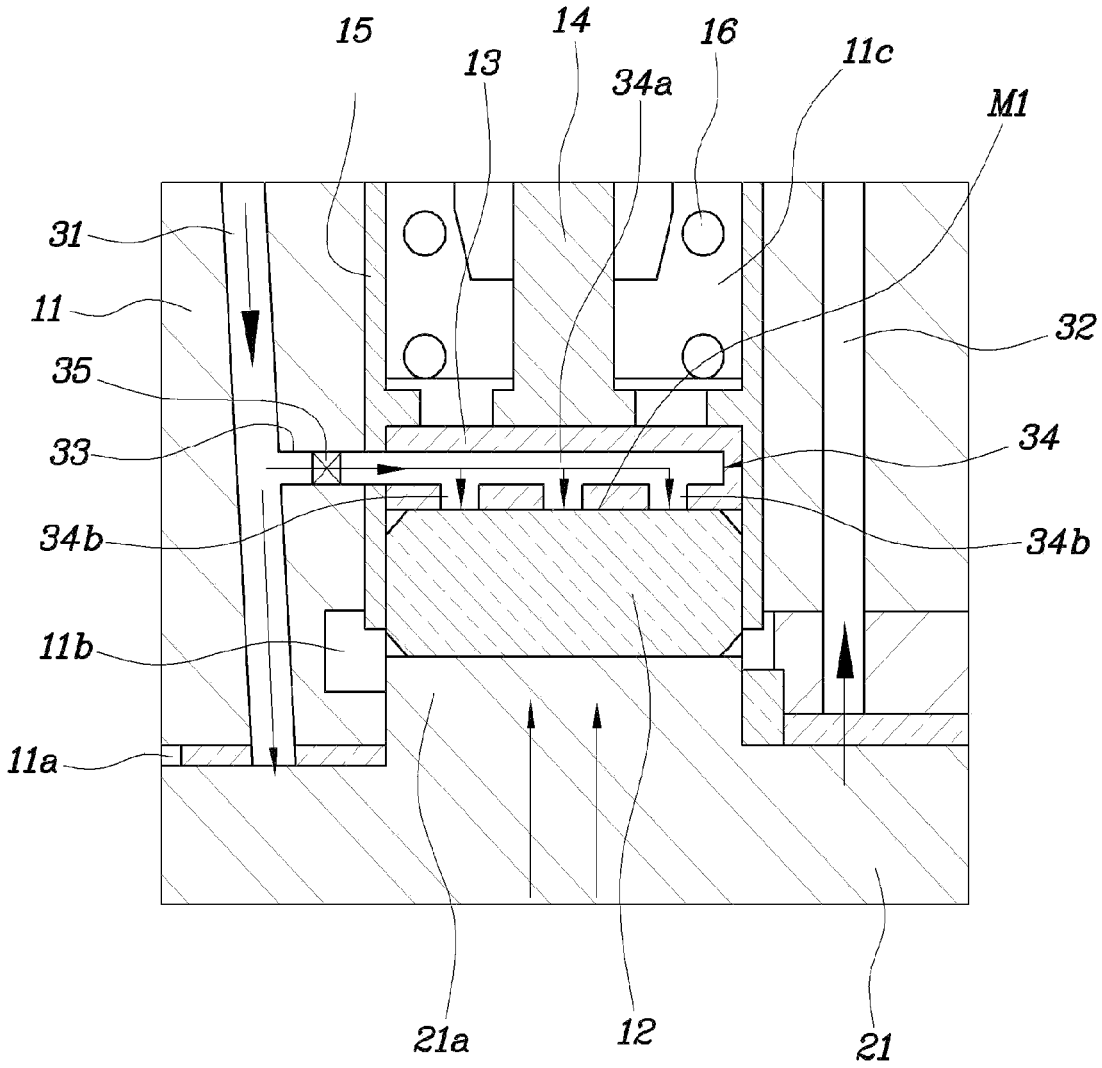
Figure 5:
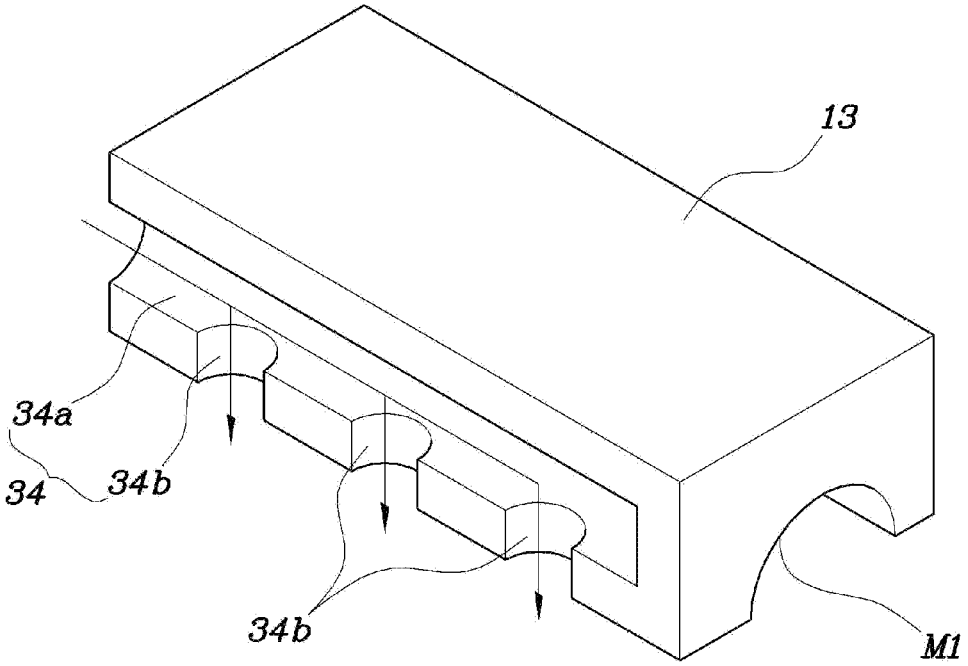
Figure 6:
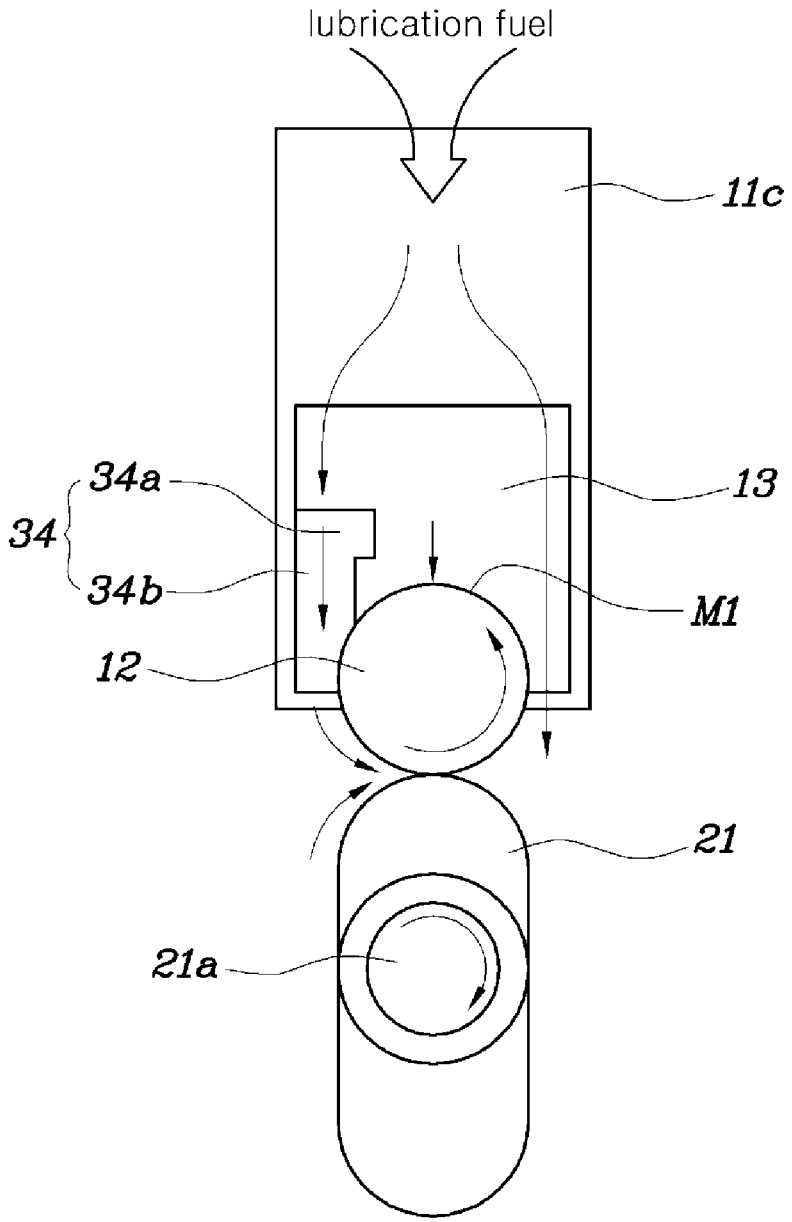

As shown in FIGS. 3 through 6, the present invention provides a high pressure pump 10 for a common rail system, which includes a pump housing 11, a roller 12, a shoe 13 and a plunger 14, with a shaft chamber 11*a*, a roller chamber 11*b* and a spring chamber 11*c* formed in the pump housing 11 in such a way that the chambers 11*a*, 11*b* and 11*c* communicate with each other.

In the shaft chamber 11*a*, a cam shaft 21 having a cam 21*a* is rotatably installed. In the roller chamber 11*b*, the roller 12 and the shoe 13 are installed in such a way that they come into contact with the cam 21*a*. In the spring chamber 11*c*, a spring 16 is installed using a spring seat 15.

Here, in the high pressure pump 10, the plunger 14 is installed in such a way that a first end thereof comes into contact with the shoe 13 and a second end thereof is located in a fuel compression chamber 17 that is formed between an inlet valve 22 and an outlet valve 23.

The inlet valve 22 is a valve that is installed in a fuel channel connected to a low pressure pump 24, and the outlet valve 23 is a valve that is installed in a fuel channel connected to a common rail 25.

Accordingly, when an engine is operated and the cam shaft 21 is rotated by the output power of the engine, the roller 12 is rotated according to a lift profile of the cam 21*a*, and pushes the shoe 13. Due to the pushed motion of the shoe 13, the plunger 14 reciprocates rectilinearly. Here, due to the rectilinear reciprocation of the plunger 14, low pressure fuel that has been supplied into the fuel compression chamber 17 through the inlet valve 22 is compressed to become high pressure fuel, and the high pressure fuel is discharged to the common rail 25 through the outlet valve 23.

Meanwhile, in the high pressure pump 10, the roller 12 and the shoe 13 are installed in such a way that they come into contact with each other under high pressure. Accordingly, when the frictional junction M1 in which the roller 12 and the shoe 13 come into contact with each other is not sufficiently lubricated, the contact surfaces of both the roller 12 and the shoe 13 are worn by friction and, occasionally, scuffing may be generated in the contact surfaces by severe friction. To solve the problems that may be caused by friction, the present invention lubricates the frictional junction M1 between the roller 12 and the shoe 13 using the fuel of the low pressure pump 24.

That is, the lubrication apparatus of the high pressure pump according to the present invention includes: a first lubrication channel 31 that connects the shaft chamber 11*a* formed in the pump housing 11 of the high pressure pump 10 to the low pressure pump 24; a third lubrication channel 33 that is formed through the pump housing 11 so as to be connected to the first lubrication channel 31 and to be open to a location in which the shoe 13 is installed; and a support lubrication groove 34 that is formed in the shoe 13 such that the support lubrication groove 34 is open to the outer surface of the shoe 13, in which a first end of the support lubrication groove 34 is connected to the third lubrication channel 33 and a second end thereof is connected to the frictional junction M1 in which the roller 12 and the shoe 13 come into contact with each other.

In other words, the third lubrication channel 33 branches from the first lubrication channel 31, and passes through both the pump housing 11 and the spring seat 15, and is open to the space inside the roller chamber 11*b* in which the shoe 13 is installed. The support lubrication groove 34 is a groove, in which the first end thereof is connected the third lubrication channel 33 and the second end thereof is connected to the frictional junction M1 in which the roller 12 and the shoe 13 come into contact with each other.

The lubrication apparatus according to the present invention further includes a check valve 35 that is installed in the third lubrication channel 33 and functions to allow a flow of fuel from the first lubrication channel 31 to the third lubrication channel 33 and to prevent a reverse flow of the fuel from the third lubrication channel 33 to the first lubrication channel 31.

The support lubrication groove 34 includes: a first support groove 34*a* that is connected to the third lubrication channel 33 and extends in a lengthwise direction of the shoe 13; and a plurality of second support grooves 34*b* that are connected to the first support groove 34*a* and are open to the frictional junction M1.

Here, the check valve 35 may be formed by one check valve 35 that installed in an inlet at which the third lubrication channel 33 is connected to the first lubrication channel 31. When the check valve 35 is formed by a plurality of check valves that are installed in the respective second support grooves 34*b*, the production cost and weight of the lubrication apparatus are increased by the increased number of the check valves 35.

Further, the plurality of second support grooves 34*b* may be formed in the lubrication apparatus such that a sufficient amount of fuel can be supplied to the frictional junction M1 through the second support grooves 34*b* within a short period of time. In the above state, the durability of the roller 12 can be improved.

As described above, in various embodiments of the present invention, part of the lubrication fuel that flows from the low pressure pump 24 to the shaft chamber 11*a* of the pump housing 11 through the first lubrication channel 31 can be directly supplied to the frictional junction M1 between the roller 12 and the shoe 13 through both the third lubrication channel 33 and the support lubrication groove 34.

Accordingly, in comparison with the conventional lubrication apparatus, the apparatus of the present invention efficiently reduces the length of the passage of the lubrication fuel supplied to the frictional junction M1 between the roller 12 and the shoe 13, thereby reducing the period of time that is required to lubricate the frictional junction M1 and allowing the frictional junction M1 to be sufficiently lubricated before the cam shaft 21 is operated. Therefore, the present invention can minimize frictional wear of the frictional junction M1 and can efficiently improve the durability of the high pressure pump 10.

In the present invention, when the lubrication fuel is supplied to the shaft chamber 11*a* through the first lubrication channel 31, the lubrication fuel flows to the spring chamber 11*c* through a second lubrication channel 32 after filling the shaft chamber 11*a*. The lubrication fuel that has been supplied to the spring chamber 11*c* is also fed from the spring chamber 11*c* to the frictional junction M1 between the roller 12 and the shoe 13 by a rotation of both the cam 21*a* and the roller 12, and so the present invention can efficiently improve the lubrication performance of the frictional junction M1 between the roller 12 and the shoe 13.

For convenience in explanation and accurate definition in the appended claims, the terms inside and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A lubrication apparatus of a high pressure pump for a common rail system, comprising:

a first lubrication channel connecting a low pressure pump to a shaft chamber formed in a pump housing of the high pressure pump;

a third lubrication channel formed through the pump housing so as to be connected to the first lubrication channel and to be open to a location in which a shoe is installed; and a support lubrication groove formed in the shoe such that the support lubrication groove is open to an outer surface of the shoe, in which a first end of the support lubrication groove is connected to the third lubrication channel and a second end of the support lubrication groove is connected to a frictional junction in which a roller and the shoe come into contact with each other.

2. The lubrication apparatus of the high pressure pump for the common rail system as set forth in claim 1, further comprising:

a check valve installed in the third lubrication channel and functioning to allow a flow of fuel from the first lubrication channel to the third lubrication channel and to prevent a reverse flow of the fuel from the third lubrication channel to the first lubrication channel.

3. The lubrication apparatus of the high pressure pump for the common rail system as set forth in claim 1, wherein the support lubrication groove comprises:

a first support groove connected to the third lubrication channel and extending in a lengthwise direction of the shoe; and a second support groove connected to the first support groove and being open to the frictional junction.

4. The lubrication apparatus of the high pressure pump for the common rail system as set forth in claim 3, wherein the second support groove comprises a plurality of second support grooves that can supply a sufficient amount of fuel to the frictional junction within a predetermined short period of time.

5. A lubrication apparatus of a high pressure pump for a common rail system, comprising:

a support lubrication groove formed in a shoe such that the support lubrication groove forms a passage for allowing fuel of a low pressure pump to flow so as to lubricate a frictional junction in which a roller and the shoe come into contact with each other, wherein the support lubrication groove comprises:

a first support groove formed such that a first end of the first support groove is connected to a channel through which the fuel of the low pressure pump is supplied to a shaft chamber in which a cam shaft is installed, and a second end of the first support groove extends in a lengthwise direction of the shoe; and a second support groove connected to the first support groove and being open to the frictional junction.

6. The lubrication apparatus of the high pressure pump for the common rail system as set forth in claim 5, wherein the support lubrication groove is formed such that the support lubrication groove communicates with a channel through which the fuel of the low pressure pump is supplied to a shaft chamber in which a cam shaft is installed.

7. The lubrication apparatus of the high pressure pump for the common rail system as set forth in claim 5, further comprising:

a check valve formed in an inlet of the support lubrication groove, the check valve functioning to allow a flow of the fuel from the low pressure pump to the frictional junction and to prevent a flow of the fuel from the frictional junction to the low pressure pump.

8. The lubrication apparatus of the high pressure pump for the common rail system as set forth in claim 5, wherein the support lubrication groove is formed such that the support lubrication groove is open to an outer surface of the shoe.

9. The lubrication apparatus of the high pressure pump for the common rail system as set forth in claim 5, wherein the second support groove comprises a plurality of second support grooves that can supply a sufficient amount of fuel to the frictional junction within a predetermined short period of time.

* * * * *